US010761464B2

(12) United States Patent
Masuda

(10) Patent No.: US 10,761,464 B2
(45) Date of Patent: Sep. 1, 2020

(54) FUSER DEVICE

(71) Applicant: KYOCERA Document Solutions Inc., Osaka (JP)

(72) Inventor: Masatoshi Masuda, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 16/676,834

(22) Filed: Nov. 7, 2019

(65) Prior Publication Data

US 2020/0150565 A1 May 14, 2020

(30) Foreign Application Priority Data

Nov. 9, 2018 (JP) ..... 2018-211842

(51) Int. Cl.
*G03G 15/20* (2006.01)

(52) U.S. Cl.
CPC ..... *G03G 15/205* (2013.01); *G03G 15/2039* (2013.01)

(58) Field of Classification Search
CPC ..... G03G 15/205; G03G 15/2039
See application file for complete search history.

(56) References Cited

U.S. PATENT DOCUMENTS 4,937,600 A * 6/1990 Hirabayashi ..... G03G 15/2003 347/129
6,160,975 A * 12/2000 Bartley ..... G05D 23/1917 219/216
8,725,018 B2 * 5/2014 Sato ..... G03G 15/55 399/68
2008/0101805 A1 * 5/2008 Hyun ..... G03G 15/2039 399/33
2009/0252521 A1 10/2009 Takami
2011/0091225 A1 * 4/2011 Yamamoto ..... G03G 15/2039 399/33
2012/0183312 A1 * 7/2012 Choi ..... G03G 15/205 399/33
2012/0301161 A1 * 11/2012 Fujimoto ..... G03G 15/205 399/33
2013/0236199 A1 * 9/2013 Yamamoto ..... G03G 15/2039 399/33
2018/0173139 A1 * 6/2018 Tanto ..... G03G 15/55

FOREIGN PATENT DOCUMENTS

JP 2012-185367 9/2009
JP 2009-251299 10/2009

* cited by examiner

*Primary Examiner* — Ryan D Walsh

(57) ABSTRACT

A fixation heater heats a specific part with resistance heating. A temperature sensor detects as a detection temperature a temperature of the specific part. An alternating current switching unit turns on and off alternating current power supply to the fixation heater. A controller controls the alternating current switching unit with a heater control signal and thereby performs temperature control of the fixation heater. An estimation calculating unit derives an estimation temperature at a second time point on the basis of the detection temperature at a first time point and the heater control signal until the second time point, and the second time point is a time point when a predetermined time elapses from the first time point. An anomaly detecting unit detects anomaly on the basis of the detection temperature at the second time point and the estimation temperature at the second time point.

6 Claims, 3 Drawing Sheets

FUSER DEVICE

CROSS-REFERENCE TO RELATED APPLICATIONS

This application relates to and claims priority rights from Japanese Patent Application No. 2018-211842, filed on Nov. 9, 2018, the entire disclosures of which are hereby incorporated by reference herein.

BACKGROUND

1. Field of the Present Disclosure

The present disclosure relates to a fuser device.

2. Description of the Related Art

An image forming apparatus watches a temperature of a fixation heater in a fuser device, and detects anomaly heating of the fuser device by comparing the temperature of the fixation heater with a predetermined reference value.

Another image forming apparatus detects a temperature of a fixation heater in N seconds after a time point of power-on or recovery from a sleep mode, and determines whether the temperature in N seconds falls into a value range of a temperature estimation table or not; and if the temperature in N seconds does not fall into the value range of the temperature estimation table, then reduces an electric power duty of the fixation heater and thereby restrains anomaly heating of a fuser device.

However, in the case that anomaly heating of the fuser device is detected by comparing a temperature of the fixation heater with a predetermined reference value, anomaly in the fuser device can hardly be detected properly with the "single" reference value because there is a difference on changing of the temperature detected by a temperature sensor when anomaly occurs, and the difference occurs due to an anomaly part in a structure of the fuser device including the heater (heating element), the temperature sensor, a belt and the like.

Further, in the case that temperature estimation of the fixation heater for a temperature at a specific time point (a time point in N seconds after power-on or recovery from a sleep mode) is performed using the "static" temperature estimation table, a continuous temperature estimation of the fixation heater can hardly be performed dynamically while the image forming apparatus is in operation.

SUMMARY

A fuser device according to an aspect of the present disclosure includes a fixation heater, a temperature sensor, an alternating current switching unit, a controller, an estimation calculating unit, and an anomaly detecting unit. The fixation heater is configured to heat a specific part with resistance heating. The temperature sensor is configured to detect as a detection temperature a temperature of the specific part. The alternating current switching unit is configured to turn on and off alternating current power supply to the fixation heater. The controller is configured to control the alternating current switching unit with a heater control signal and thereby perform temperature control of the fixation heater. The estimation calculating unit is configured to derive an estimation temperature at a second time point on the basis of the detection temperature at a first time point and the heater control signal until the second time point, and the second time point is a time point when a predetermined time elapses from the first time point. The anomaly detecting unit is configured to detect anomaly on the basis of the detection temperature at the second time point and the estimation temperature at the second time point.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
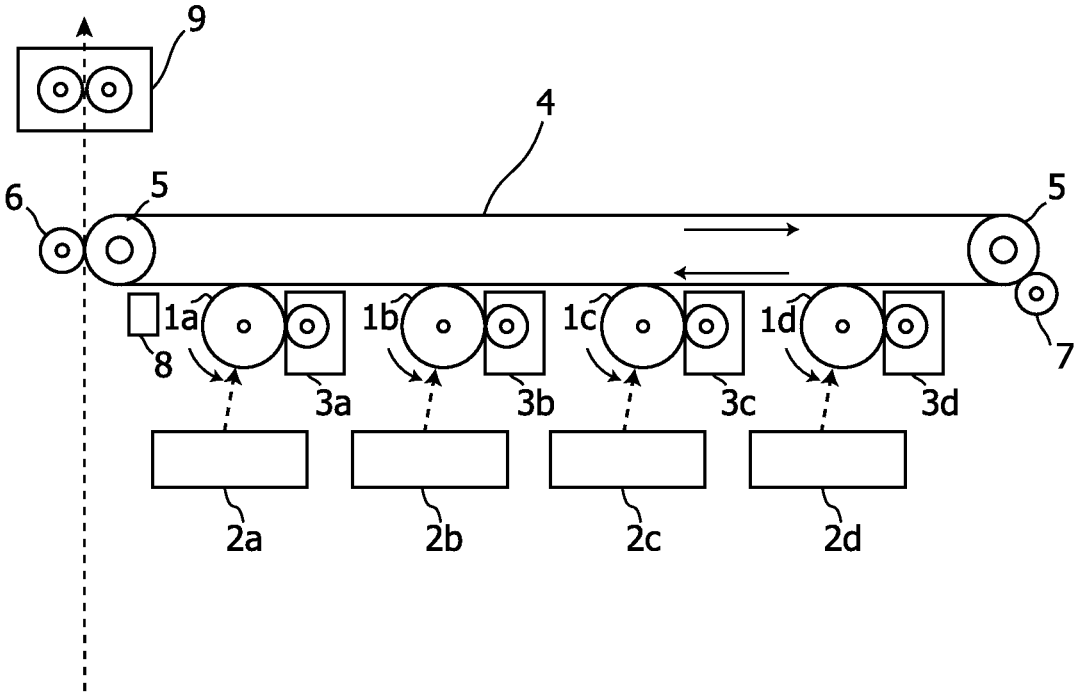
FIG. 1 shows a side view that indicates an internal mechanical configuration of an image forming apparatus that includes a fuser device in an embodiment according to the present disclosure.

FIG. 1 shows a side view that indicates an internal mechanical configuration of an image forming apparatus that includes a fuser device in an embodiment according to the present disclosure. The image forming apparatus shown in FIG. 1 is an apparatus including an electrophotographic printing function, such as a printer, a facsimile machine, a copier or a multi function peripheral.

The image forming apparatus in this embodiment includes a tandem-type color development device. This color development device includes photoconductor drums 1*a* to 1*d*, exposure devices 2*a* to 2*d*, and development devices 3*a* to 3*d*. The photoconductor drums 1*a* to 1*d* are photoconductors of four colors: Cyan, Magenta, Yellow and Black.

The exposure devices 2*a* to 2*d* irradiate the photoconductor drums 1*a* to 1*d* with laser light and thereby form electrostatic latent images. Each of the exposure devices 2*a* to 2*d* includes a laser diode as a light source of the laser light, optical elements (such as lens, mirror and polygon mirror) that guide the laser light to the photoconductor drum 1*a*, 1*b*, 1*c*, or 1*d*.

Further, the periphery of each one of the photo conductor drums 1*a* to 1*d* includes a charging unit such as scorotron, a cleaning device, a static electricity eliminator and the like. The cleaning device removes residual toner on each one of the photo conductor drums 1*a* to 1*d* after primary transfer. The static electricity eliminator eliminates static electricity of each one of the photoconductor drums 1*a* to 1*d* after primary transfer.

Toner cartridges which contain toner of four colors: Cyan, Magenta, Yellow and Black are attached to the development devices 3*a* to 3*d*, respectively. In the development devices 3*a* to 3*d*, the toner is supplied from the toner cartridges, and this toner and carrier compose developer. The development devices 3*a* to 3*d* form toner images by attaching the toner to electrostatic latent images on the photoconductor drums 1*a* to 1*d*.

The photoconductor drum 1*a*, the exposure device 2*a* and the development device 3*a* perform development of Magenta. The photoconductor drum 1*b*, the exposure device 2*b* and the development device 3*b* perform development of Cyan. The photoconductor drum 1*c*, the exposure device 2*c* and the development device 3*c* perform development of Yellow. The photoconductor drum 1*d*, the exposure device 2*d* and the development device 3*d* perform development of Black.

The intermediate transfer belt 4 is a loop-shaped image carrier, and contacts the photoconductor drums 1*a* to 1*d*. Toner images on the photoconductor drums 1*a* to 1*d* are primarily transferred onto the intermediate transfer belt 4. The intermediate transfer belt 4 is hitched around driving rollers 5, and rotates by driving force of the driving rollers 5 towards the direction from the contact position with the photoconductor drum 1*d* to the contact position with the photoconductor drum 1*a*.

A transfer roller 6 causes an incoming paper sheet in transportation to contact the transfer belt 4, and secondarily transfers the toner image on the transfer belt 4 to the paper sheet. The paper sheet on which the toner image has been secondarily transferred is transported to the fuser device 9.

A roller 7 has a cleaning brush, and removes residual toner on the intermediate transfer belt 4 by contacting the cleaning brush to the intermediate transfer belt 4 after transferring the toner image to the paper sheet.

A sensor 8 is an optical sensor used for toner density measurement, and irradiates the intermediate transfer belt 4 with a light beam and detects its reflection light. For example, in density adjustment, the sensor 8 irradiates a predetermined area on the intermediate transfer belt 4 with a light beam, detects its reflection light, and outputs an electrical signal corresponding to the detected intensity of the reflection light.

The fuser device 9 fixes a toner image that has been transferred on a recording medium such as paper sheet in a heating and pressurizing manner.

Figure 2:
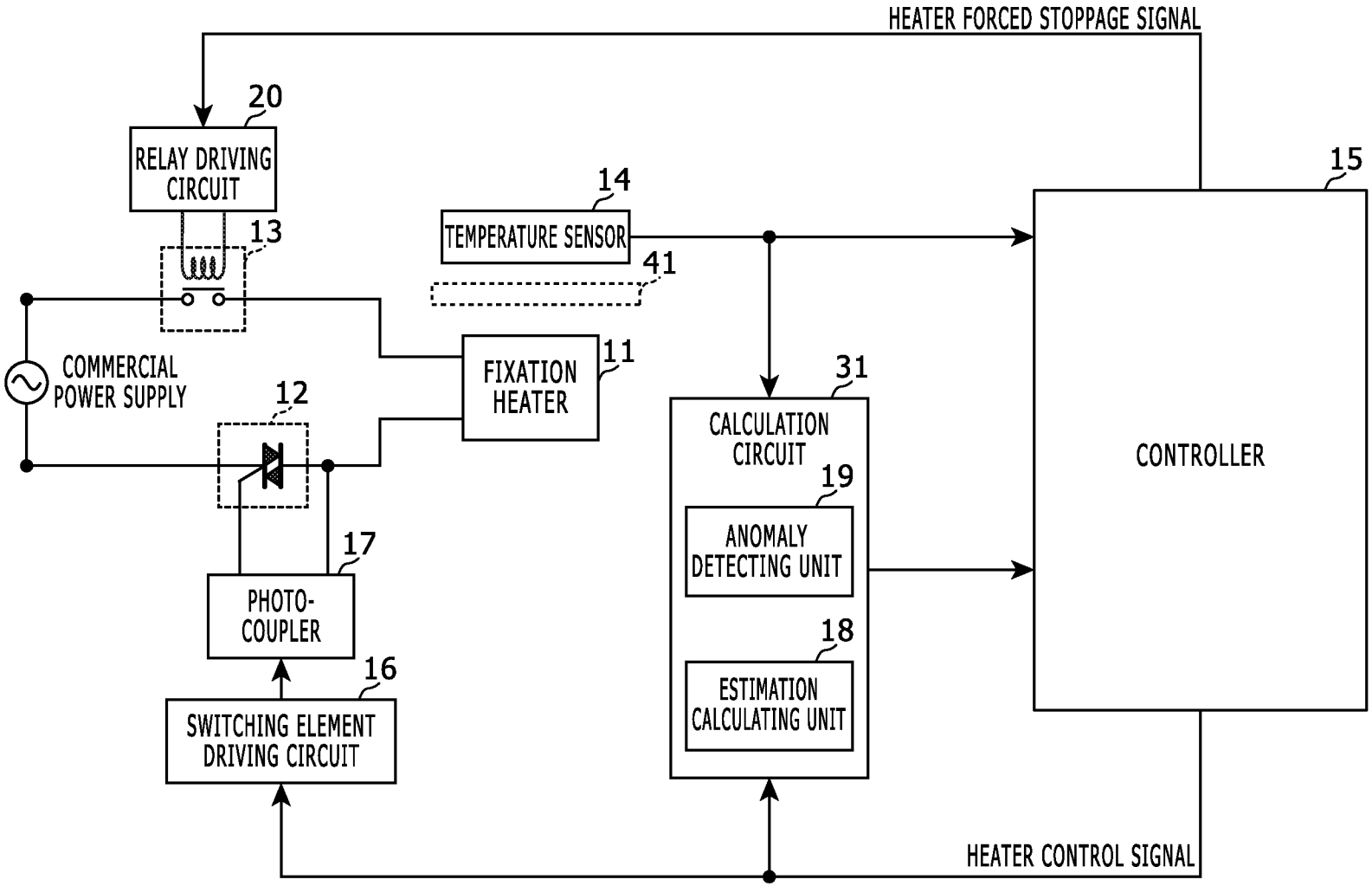
FIG. 2 shows a circuit diagram that indicates a part of an electronic configuration of the fuser device 9 in the embodiment according to the present disclosure.

FIG. 2 shows a circuit diagram that indicates a part of an electronic configuration of the fuser device 9 in the embodiment according to the present disclosure.

As shown in FIG. 2, the fuser device 9 includes a fixation heater 11 to which alternating current power based on commercial power supply is supplied. The fixation heater 11 is a heater including a resistance heating element, such as ceramic heater or planar heater. For example, the fixation heater 11 is arranged in an internal structural member that supports a fixation belt, a fixation film or the like, in a fixation roller, or the like. Thus, the fixation heater 11 heats a specific part 41 (i.e. the fixation belt, the fixation film, the fixation roller or the like) with resistance heating.

Further, as shown in FIG. 2, an alternating current switching unit 12, a relay 13 and the like are installed between the commercial alternating current power supply and the fixation heater 11.

The alternating current switching unit 12 includes a switching element (here, bidirectional thyristor) connected in series to the fixation heater 11, and turns on and off alternating current power supply to the fixation heater 11 using the switching element. Here, a bidirectional thyristor is used in the alternating current switching unit 12 because alternating current power is supplied to the fixation heater and the bidirectional thyristor is capable of bidirectionally conducting current.

Further, the fuser device 9 includes a temperature sensor 14, a controller 15, a switching element driving circuit 16, a photocoupler 17, an estimation calculating unit 18, an anomaly detecting unit 19, and a relay driving circuit 20.

The temperature sensor 14 is a thermistor or the like, detects as a detection temperature a temperature of the aforementioned specific part 41, and outputs an electric signal corresponding to the detection temperature.

The controller 15 controls the alternating current switching unit 12 with a heater control signal, and thereby performs temperature control of the fixation heater 11. In this embodiment, the controller 15 is a microcomputer that executes a control program, and thereby applies the heater control signal to the alternating current switching unit 12 through the switching element driving circuit 16 and the photocoupler 17. The switching element driving circuit 16 includes, for example, an amplifier, a D/A converter and the like, and outputs the heater control signal as an analog signal to the photocoupler 17. The photocoupler 17 applies the heater control signal to the switching element of the alternating current switching unit 12 while keeping electricity insulation between a power line of the fixation heater 11 and a control line of the controller 15 and the like. For example, the heater control signal takes a high level in a turning-on period of the alternating current switching unit 12, and takes a low level in a turning-off period of the alternating current switching unit 12.

The estimation calculating unit 18 derives an estimation temperature Temp_est(i+1) at a second time point Till on the basis of the detection temperature Temp(i) at a first time point Ti and the heater control signal until the second time point Till; and here the second time point Till is a time point when a predetermined time dt elapses from the first time point Ti. For example, the predetermined time dt is set, as any in a range from one second to five seconds, in accordance with a temperature rising characteristic (e.g. rising temperature per unit time) of the fixation heater 11.

For example, the estimation calculating unit 18 derives the estimation temperature Temp_est(i+1) at the second time point Ti+1 from (a) the detection temperature Temp(i) at the first time point Ti and (b) the heater control signal from the first time point Ti until the second time point Ti+1, in accordance with a predetermined calculation formula based on a structure of the fuser device 9.

Specifically, a relationship between a current-flow period (i.e. supplied electric energy) to the fixation heater 11 and a rising temperature of the fixation heater 11 is determined by terms of an experiment or a thermal computational simulation (i.e. thermal conductivity analysis), and the calculation formula is derived so as to express the relationship. Further, the estimation calculating unit 18 calculates a temperature changing amount during the predetermined time dt in accordance with the calculation formula and adds the temperature changing amount to the detection temperature Temp(i) at the first time point Ti, and thereby derives the estimation temperature Temp_est(i+1) at the second time point Ti+1.

The anomaly detecting unit 19 detects anomaly of the fuser device 9 on the basis of (a) the detection temperature Temp(i+1) at the second time point Ti+1 and (b) the estimation temperature Temp_est(i+1) at the second time point Ti+1. For example, the anomaly detecting unit 19 determines whether an absolute value of a difference between the detection temperature Temp(i+1) at the second time point Ti+1 and the estimation temperature Temp_est(i+1) at the second time point Ti+1 exceeds a predetermined threshold value or not; and if the absolute value of the difference exceeds the predetermined threshold value, then determines that anomaly occurs, and if the absolute value of the difference does not exceed the predetermined threshold value, then determines that anomaly does not occur.

In this embodiment, the estimation calculating unit 18 repeatedly derives the estimation temperature with an interval of the aforementioned predetermined time dt; and the anomaly detecting unit 19 repeatedly determines with an interval of the aforementioned predetermined time dt whether anomaly occurs in the fuser device 9 or not on the basis of the detection temperature Temp at the second time point Ti+1 and the estimation temperature Temp_est at the second time point Ti+1.

Further, in this embodiment, the controller 15 is a processor for program control; and the estimation calculating unit 18 and the anomaly detecting unit 19 are specific-purpose calculating circuits (here, analog circuits) other than the processor. Thus, the estimation calculating unit 18 and the anomaly detecting unit 19 are installed as such specific-purpose calculating circuits that do not depend on the program control, and consequently, a trouble due to its program runaway is restrained.

Further, in this embodiment, when detecting the anomaly, the controller 15 (*a*) performs warning or (b) controls the relay driving circuit 20 with a heater forced stoppage signal and thereby performs forcible cut-off of the aforementioned alternating current power supply. For example, the relay driving circuit 20 is a power amplifier circuit, and causes the relay 13 to perform a cut-off action if the heater forced stoppage signal gets a high level.

Figure 3:
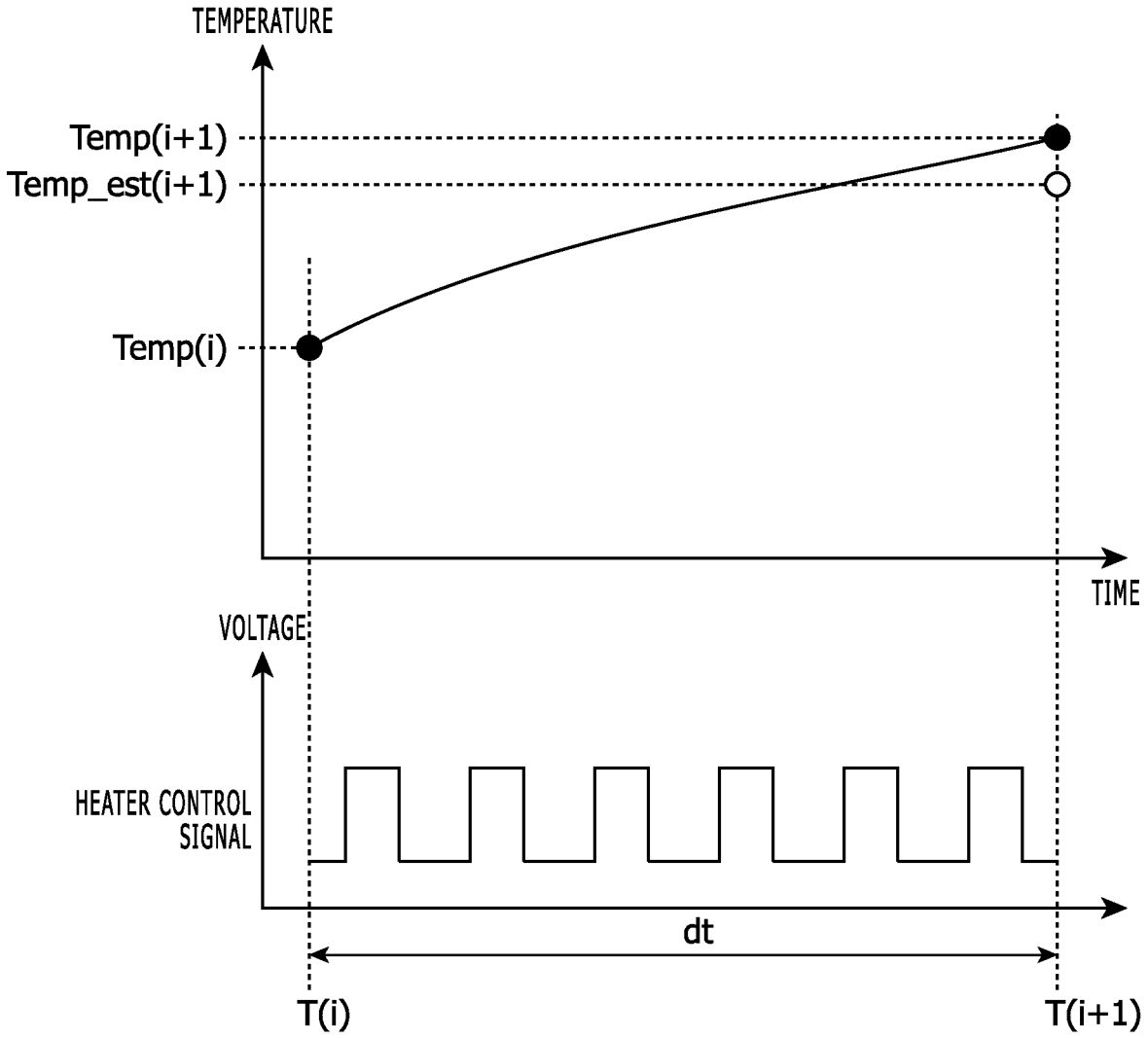
FIG. 3 shows a timing chart that explains a behavior of the fuser device 9 shown in FIGS. 1 and 2.

The following part explains a behavior of the aforementioned fuser device 9. FIG. 3 shows a timing chart that explains a behavior of the fuser device 9 shown in FIGS. 1 and 2.

While the fuser device 9 is in operation, the controller 15 applies the heater control signal to the alternating current switching unit 12 through the switching element driving circuit 16 and the photocoupler 17, and thereby causes the fixation heater 11 to operate. Here, the controller 15 adjusts the heater control signal on the basis of a sensor signal outputted from the temperature sensor 14, and thereby performs temperature control of the fixation heater 11. The sensor signal outputted from the temperature sensor 14 is an analog signal and is converted to a digital signal in the controller 15.

Meanwhile, as shown in FIG. 3, the estimation calculating unit 18 (*a*) measures a current-flow period of the fixation heater 11 on the basis of a level of the heater control signal during the predetermined time dt, and (b) with an interval of the predetermined time dt, repeatedly (b1) acquires a detection temperature Temp(i+1), (b2) calculates a temperature changing amount corresponding to the current-flow period of the fixation heater 11, and (b3) calculates an estimation temperature Temp_est(i+1) according to the detection temperature Temp(i) at the previous time point and this temperature changing amount.

Here, a period that the heater control signal takes a high level is determined as the current-flow period of the fixation heater 11, and the temperature changing amount is calculated on the basis of an electric energy supplied to the fixation heater 11 during the predetermined time dt. For example, the period that the heater control signal takes a high level within the predetermined time dt may be derived from an integrated value obtained by integrating the heater control signal using an analog integrating circuit (namely, an output level of the analog integrating circuit).

It should be noted that the acquired detection temperature is maintained in a memory or the like until calculation of the estimation temperature at the next time point is completed.

Further, as shown in FIG. 3, the anomaly detecting unit 19, repeatedly at time points with an interval of the predetermined time dt, acquires a detection temperature Temp(i+1), and determines whether anomaly (for example, wire breaking of the fixation heater 11, wire breaking of the temperature sensor 14, damage of the fixation belt or the fixation film, or the like) occurred within the predetermined time dt or not on the basis of the detection temperature Temp(i+1) and the estimation temperature Temp_est(i+1). Thus, if anomaly (damage or the like) occurred in the fixation belt, the anomaly is detected on the basis of the detection and estimation temperatures at the second time point.

Thus, if the second time point is a current time point, then the anomaly detecting unit 19 detects anomaly that occurred from a time point past by the predetermined time (i.e. the first time point) until the current time point.

As mentioned, in the aforementioned embodiment, the fixation heater 11 heats a specific part 41 with resistance heating, and the temperature sensor 14 detects as a detection temperature a temperature of the specific part 41. The alternating current switching unit 12 turns on and off alternating current power supply to the fixation heater 11, and the controller 15 controls the alternating current switching unit 12 with a heater control signal, and thereby performs temperature control of the fixation heater 11. Further, the estimation calculating unit 18 derives an estimation temperature Temp_est(i+1) at a second time point Ti+1 on the basis of the detection temperature Temp(i) at a first time point Ti and the heater control signal until the second time point Ti+1 where the second time point Ti+1 is a time point when a predetermined time dt elapses from the first time point Ti, and the anomaly detecting unit 19 detects anomaly on the basis of the detection temperature Temp(i+1) at the second time point Ti+1 and the estimation temperature Temp_est(i+1) at the second time point Ti+1.

Consequently, while the fuser device 9 is in operation, proper anomaly detection is continuously performed. In addition, even if unexpected anomaly occurs in the fuser device 9, the unexpected anomaly will be detected with a relatively high possibility.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, the controller 15 outputs the heater forced stoppage signal. Alternatively, the calculation circuit 31 (e.g. the anomaly detecting unit 19) may directly output the heater forced stoppage signal to the relay driving circuit 20 when the anomaly is detected.

Further, in the aforementioned embodiment, the functions of the calculation circuit 31 (i.e. the estimation calculating unit 18 and the anomaly detecting unit 19) may be installed in the controller 15, and in such a case, the calculation circuit 31 may not be required.

What is claimed is:

1. A fuser device, comprising:

a fixation heater configured to heat a specific part with resistance heating;

a temperature sensor configured to detect as a detection temperature a temperature of the specific part;

an alternating current switching unit configured to turn on and off alternating current power supply to the fixation heater;

a controller configured to control the alternating current switching unit with a heater control signal and thereby perform temperature control of the fixation heater;

an estimation calculating unit configured to derive an estimation temperature at a second time point on the basis of the detection temperature at a first time point and the heater control signal until the second time point, the second time point being a time point when a predetermined time elapses from the first time point; and an anomaly detecting unit configured to detect anomaly on the basis of the detection temperature at the second time point and the estimation temperature at the second time point.

2. The fuser device according to claim 1, wherein the estimation calculating unit repeatedly derives the estimation temperature with an interval of the predetermined time; and the anomaly detecting unit repeatedly determines with an interval of the predetermined time whether anomaly occurs or not on the basis of the detection temperature at the second time point and the estimation temperature at the second time point.

3. The fuser device according to claim 1, wherein the estimation calculating unit derives the estimation temperature at the second time point from (a) the detection temperature at the first time point and (b) the heater control signal from the first time point until the second time point, in accordance with a predetermined calculation formula based on a structure of the fuser device.

4. The fuser device according to claim 1, further comprising a fixation belt;

wherein the anomaly detecting unit detects anomaly on the basis of the detection temperature at the second time point and the estimation temperature at the second time point when the anomaly occurs at the fixation belt.

5. The fuser device according to claim 1, wherein the controller is a processor for program control; and the estimation calculating unit and the anomaly detecting unit are specific-purpose calculating circuits other than the processor.

6. The fuser device according to claim 1, wherein the controller performs (a) warning or (b) forcible cut-off of the alternating current power supply when detecting the anomaly.

* * * * *